US007914308B2

(12) United States Patent
Boyd

(10) Patent No.: US 7,914,308 B2
(45) Date of Patent: Mar. 29, 2011

(54) ELECTRICAL DISCONNECT

(75) Inventor: Don M. Boyd, Cyril, OK (US)

(73) Assignee: Power Line Products, L.L.C., Oklahoma City, OK (US)

( * ) Notice: Subject to any disclaimer, the term of this patent is extended or adjusted under 35 U.S.C. 154(b) by 0 days.

(21) Appl. No.: 12/397,391

(22) Filed: Mar. 4, 2009

(65) Prior Publication Data

US 2010/0227510 A1 Sep. 9, 2010

(51) Int. Cl.
*H01R 13/62* (2006.01)

(52) U.S. Cl. ..... 439/180; 439/281

(58) Field of Classification Search ..... 439/180, 439/923, 281, 732
See application file for complete search history.

(56) References Cited

U.S. PATENT DOCUMENTS

| | | | | |
|---|---|---|---|---|
| 1,753,317 | A | | 4/1930 | Rothen |
| 2,497,523 | A | | 2/1950 | Warkentin |
| 2,666,189 | A | | 1/1954 | Cook |
| 2,794,963 | A | | 6/1957 | Hess et al. |
| 2,848,572 | A | | 8/1958 | Wagnecz |
| 2,860,316 | A | | 11/1958 | Watters et al. |
| 2,919,317 | A | | 12/1959 | Mercer et al. |
| 2,992,404 | A | | 7/1961 | Berg |
| 3,348,001 | A | | 10/1967 | Upton, Jr. et al. |
| 3,673,313 | A | | 6/1972 | Pickett et al. |
| 3,711,818 | A | | 1/1973 | Swehla |
| 3,842,393 | A | * | 10/1974 | Glover et al. ..... 439/281 |
| 4,094,565 | A | | 6/1978 | Parrier et al. |
| 4,166,664 | A | | 9/1979 | Herrmann, Jr. |
| 4,628,392 | A | | 12/1986 | Didier |
| 4,698,717 | A | | 10/1987 | Scheid |
| 5,030,122 | A | | 7/1991 | Birch et al. |
| 5,044,997 | A | | 9/1991 | Gellenthin, Jr. |
| 5,399,102 | A | * | 3/1995 | Devine ..... 439/505 |
| 5,401,181 | A | * | 3/1995 | Wilson ..... 439/281 |
| 5,462,452 | A | * | 10/1995 | Devine ..... 439/505 |
| 5,707,250 | A | * | 1/1998 | Smithson ..... 439/504 |
| 5,941,729 | A | * | 8/1999 | Sri-Jayantha ..... 439/505 |
| 6,910,911 | B2 | | 6/2005 | Mellott et al. |
| 6,971,898 | B2 | | 12/2005 | Ostendorp |
| 7,392,585 | B2 | | 7/2008 | Ostendorp |

OTHER PUBLICATIONS

Milbank Mfg. Co, Meter Mounting Equipment catalog, Aug. 2007, Kansas City, MO.

* cited by examiner

*Primary Examiner* — Tho D Ta
(74) *Attorney, Agent, or Firm* — Dunlap Codding, P.C.

(57) ABSTRACT

An electrical disconnect for detachably connecting segments of a drip loop of an electrical service line of a structure, the drip loop having a structure side segment and a service line segment, the electrical disconnect having a first portion connected to the structure side segment of the drip loop, the first portion comprising at least one male electrical conductor extending therefrom and a second portion connected to the service line segment of the drip loop.

7 Claims, 4 Drawing Sheets

ELECTRICAL DISCONNECT

BACKGROUND OF THE INVENTION

1. Field of the Invention

This invention relates to an electrical disconnect, and more particularly, but not by way of limitation, to an electrical disconnect for detachably connecting segments of an electrical service line.

2. Brief Description of Related Art

Electrical service lines, also known as a triplex (residential) or quadplex (industrial) lines, are utilized to transmit an electrical current from, for example, a utility line to a structure. Triplex lines generally include two 110 volt conductor lines and one neutral line. The neutral line is connected and/or anchored to the structure and supports the two conductor lines. The conductor lines and the neutral line are connected to a meter assembly connected to the structure. Typical meter assemblies include a weatherhead which receives the ends of the conductor lines and the neutral line. The weatherhead is angled to prevent water from entering the weatherhead and causing a short-circuit or other damage. The weatherhead is connected to a meter via a mast and the meter measures the electrical usage of the structure.

To further prevent water entering the weatherhead, each of the conductor lines and the neutral line include a drip loop segment which is a concave loop formed at the end of the lines closest to the weatherhead of the meter assembly. The drip loop directs water collecting along the length of the lines towards the lower portion of the drip loop and drips down onto the ground below.

Added forces from, for example, a tree limb falling on the electrical service line, or ice accumulation along the electrical service line can impart tensile forces on the neutral line which may separate the neutral line from the structure. Once the neutral line is separated from the structure, the electrical conductor lines are no longer supported and may separate from the weatherhead or cause other damage to the meter assembly, for example, ripping the weatherhead or the mast from the meter assembly. Additionally, the neutral line may separate from the weatherhead as well. If the conductor lines separate from the meter assembly, they generally fall to the ground where they may pose a significant danger. If an individual or animal comes into contact with one of the live electrical conductor lines, serious electrical shock and potential death may occur.

Additionally, any damage to the meter assembly is the sole responsibility of the structure owner and can have unwanted financial implications.

Attempts have been made to produce electrical disconnects which are connected proximate to the utility pole, but these electrical disconnects must be able to support forces including the weight of the conductor lines. Furthermore, these types of electrical disconnects must be re-connected by a licensed employee of the electrical service company at significant cost to the structure owner.

Therefore, a need exists for a electrical disconnect that allows sections of the drip loops of an electrical service line to separate to prevent damage to the electrical service line and/or the meter assembly if a sufficient force is applied to the electrical service line. Additionally, a need exists for an electrical disconnect which electrically insulates individuals and/or animals from the live wire portion of the electrical service line when it is disconnected from the meter assembly. It is to such an electrical disconnect that the present invention is directed.

BRIEF DESCRIPTION OF THE SEVERAL VIEWS OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments. Further, the figures are not necessarily to scale and certain features and certain views of the figures may be shown exaggerated in scale or in schematic in the interest of clarity and conciseness.

DETAILED DESCRIPTION OF EXEMPLARY EMBODIMENT

Figure 1:
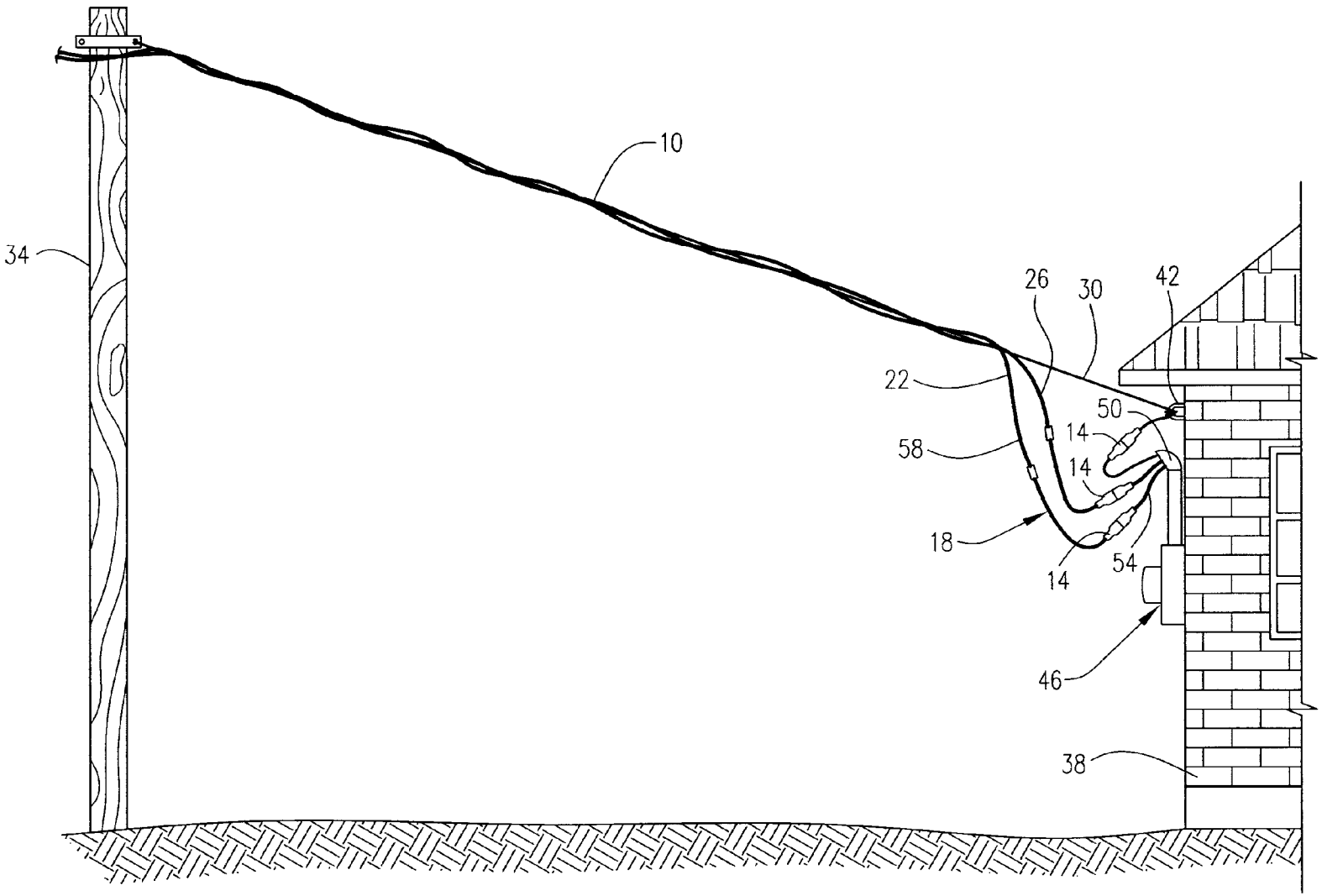
FIG. 1 is side elevational view of a triplex service line having two electrical conductor lines and a neutral line, each of the electrical conductor lines having an electrical disconnect in accordance with the present invention.

Referring now to the drawings and, more particularly to FIG. 1, shown therein is an electrical service line 10 having electrical disconnects 14 for joining segments of a drip loop 18 of the electrical service line 10. In general, the electrical service line 10, also known as a triplex in residential applications, includes two 110 volt electrical conductor lines 22 and 26, as well as a neutral line 30. It will be understood that although a triplex has been disclosed, any type of electrical service line, for example, a quadplex, that would be known to one of ordinary skill in the art with the present disclosure before them are likewise contemplated for use in accordance with the present invention. The electrical service line 10 typically extends from a utility pole 34 and spans across an area above the ground and connects to various parts of a structure 38 to provide electrical current to the structure 38. The electrical conductor lines 22 and 26 are wound around the neutral line 30 which is typically anchored to the structure 38 at a connector 42 positioned above a meter assembly 46. One of the functions of the neutral line 30 is that it supports the weight of the electrical conductor lines 22 and 26. The electrical conductor lines 22, 26 and the neutral line 30 are connected proximate the structure 38 and to the meter assembly 46 via a weatherhead 50.

The electrical conductor lines 22, 26 and neutral line 30 each include a drip loop 18. The drip loop 18 is an arcuate or "looped" segment having a lower portion positioned below the entrance to the weatherhead 50 for directing water collecting/traveling along the electrical conductor lines 22, 26 and the neutral line 30 downwardly and off of the electrical conductor lines 22, 26 and the neutral line 30 towards the ground below. The drip loops 18 substantially prevent water collecting/traveling along the electrical conductor lines 22, 26 and the neutral line 30 from entering the weatherhead 50 of the meter assembly 46. Water entering the weatherhead 50 may cause a short circuit and/or other damage to the meter assembly 46 and/or the structure 38.

Each drip loop 18 of each of the electrical conductor lines 22, 26 and the neutral line 30 is provided with an electrical disconnect 14. Each of the electrical disconnects 14 are disposed along the drip loops 18 to detachably connect two segments of the drip loops 18, namely a structure side segment 54 and a service line segment 58.

Figure 2:
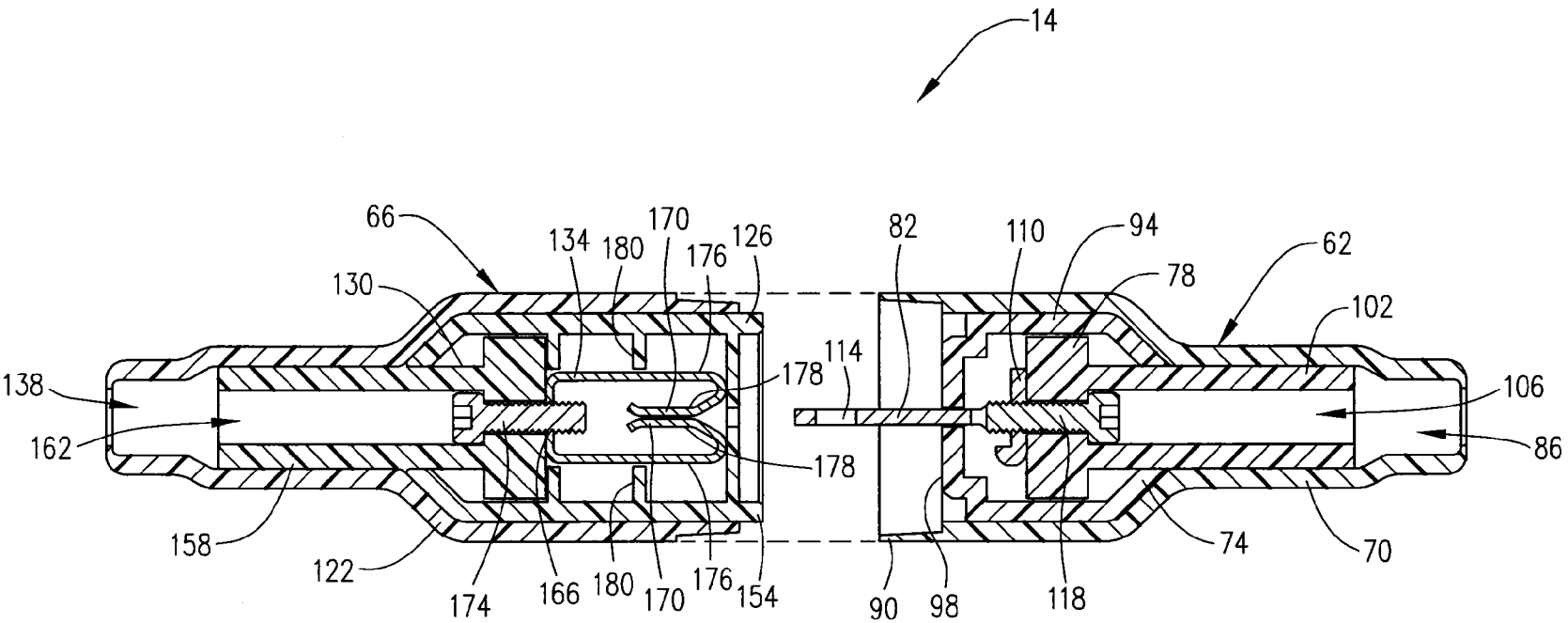
FIG. 2 is a cross sectional view of an electrical disconnect having a first portion and a second portion shown in a disconnected condition.
Figure 3:
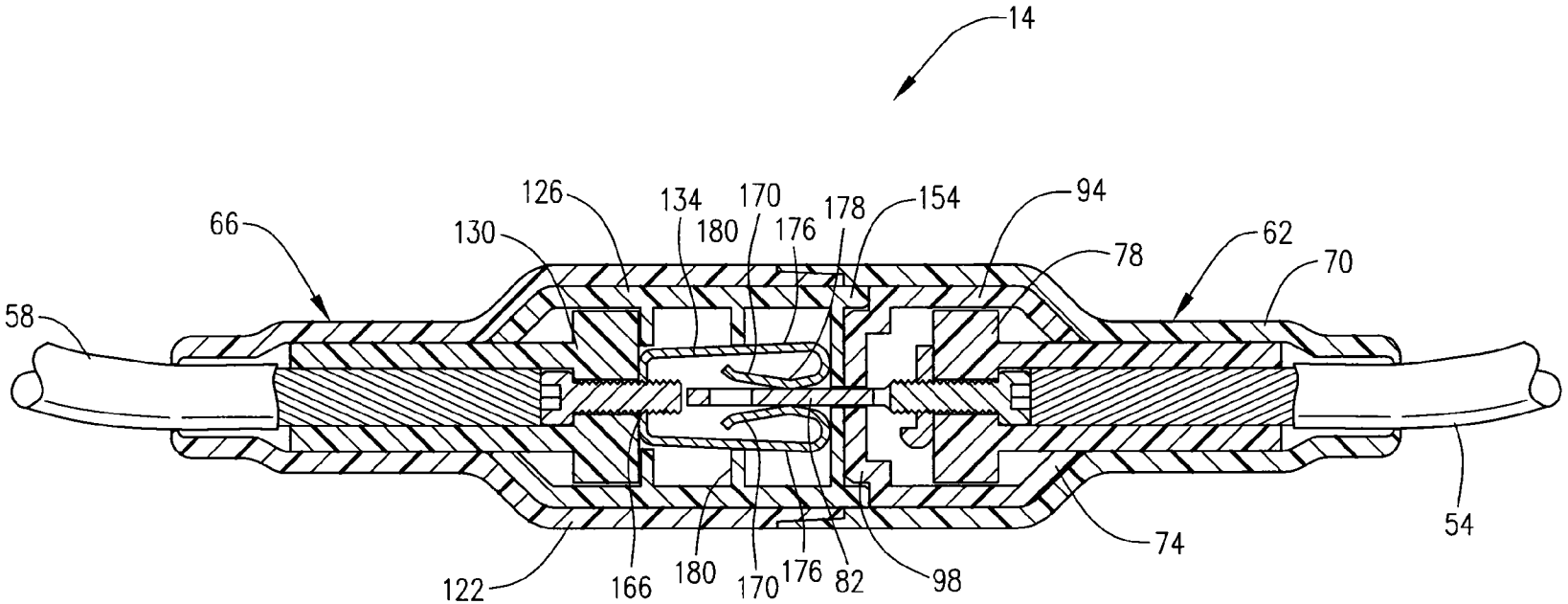
FIG. 3 is a cross sectional view of the electrical disconnect shown in a connected condition and having the first portion in association with a structure side segment of a drip loop and the second portion in association with a service line segment of a drip loop.
Figure 4:
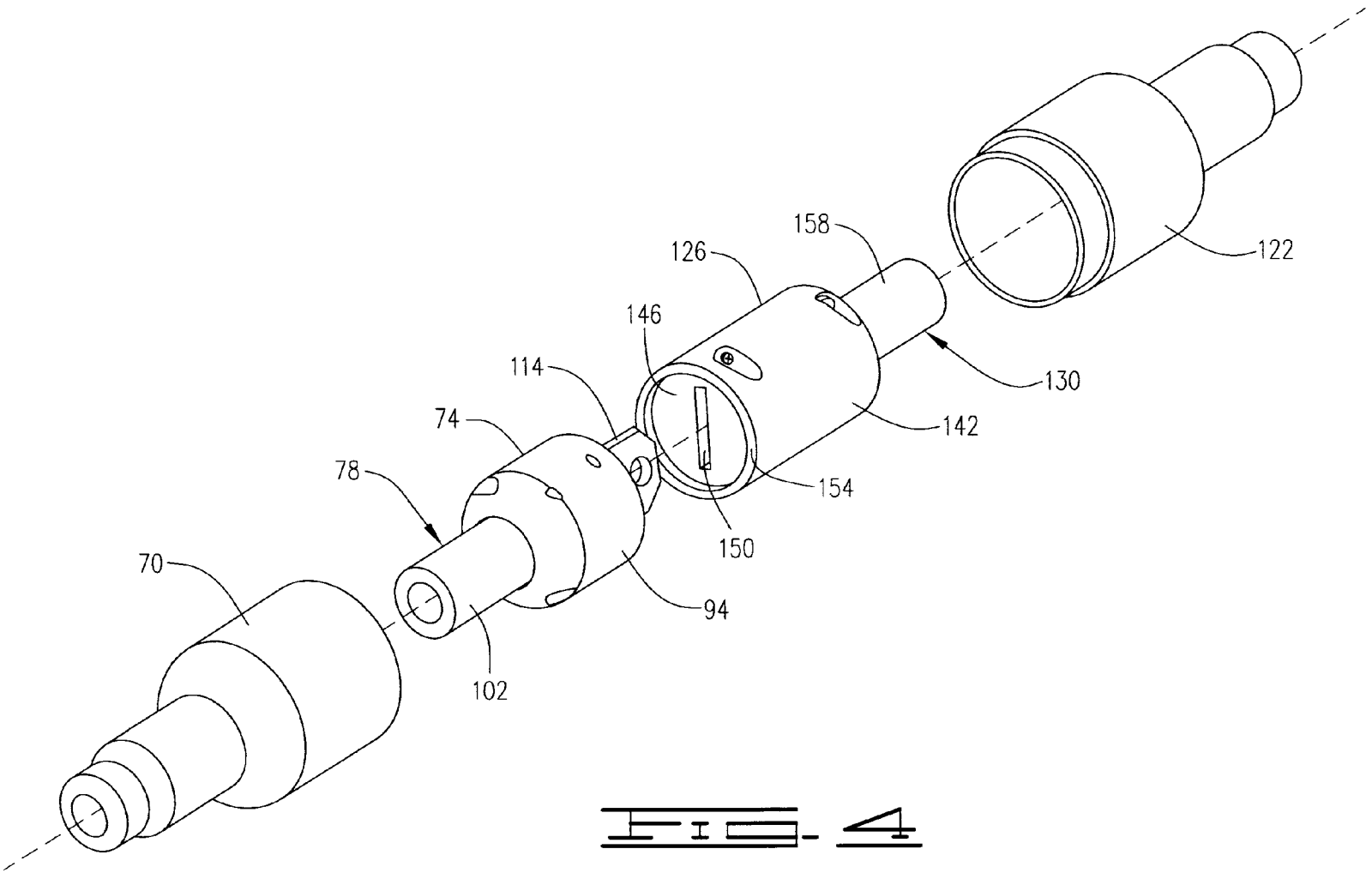
FIG. 4 is an exploded, perspective view of the electrical disconnect.

Referring now to FIGS. 2-4 collectively, shown is one of the electrical disconnects 14. The electrical disconnect 14 includes a first portion 62 and a second portion 66. The first portion 62 includes an insulated housing 70 which substantially covers a supporting enclosure 74, a conductor body 78, and one or more male electrical conductors 82. The insulated housing 70 may be constructed from, or covered by, a dielectric material, for example, a rubber, glass, polytetrafluroethylene, or the like. The insulated housing 70 includes an opening 86 formed so as to receive at least a portion of the structure side segment 54 of the drip loop 18 therethrough (see FIG. 3). Additionally, the insulated housing 70 may include an extended portion 90 that cooperates with an insulated housing of the second portion 66 (as will be discussed below) in such a way that the first portion 62 and the second portion 66 may cooperate to form a continuous insulated covering when the first portion 62 and the second portion 66 are joined together.

The supporting enclosure 74 is disposed within the insulated housing 70 and may be constructed from a dielectric material similarly to the insulated housing 70. The supporting enclosure 74 operates to cover at least a portion of the one or more male electrical conductors 82 and at least a portion of the conductor body 78. In one embodiment, the support enclosure 74 includes a substantially cylindrical body 94 (see FIG. 4). The substantially cylindrical body 94 is constructed having a cylindrical protrusion 98 (FIGS. 2 and 3) adapted to mate with at least a portion of the second portion 66 as will be discussed in greater detail below.

The conductor body 78 is disposed within the insulated housing 70 and is constructed of an electrically conductive material, for example, copper, gold, silver, aluminum, graphite and the like. The conductor body 78 provides for the communication of an electrical current from the male electrical conductor 82 to the structure side segment 54 of the drip loop 18. In one embodiment, the conductor body 78 includes a first portion 102 having an opening 106 positioned in axial alignment with the opening 86 of the insulated housing 70 to receive and retain at least a portion of the structure side segment 54 of the drip loop 18 therein.

The male electrical conductor 82 is constructed of an electrically conductive material, for example, copper, gold, silver, aluminum, graphite and the like. In one embodiment, the male electrical conductor 82 comprises a connector portion 110 and a blade portion 114. The connector portion 110 is connectable to the conductor body 78 via a fastener 118, for example, a threaded fastener, although any number of fasteners which would be known to one of ordinary skill in the art with the present disclosure before them are likewise contemplated for use in accordance with the present invention. Additionally, it will be understood that the male electrical conductor 82 and the conductor body 78 may be fabricated as a unitary member.

The blade portion 114 of the male electrical conductor 82 is shown as extending from inside the cylindrical protrusion 98 of the supporting enclosure 74 of the first portion 62 and extending at least partially beyond the extended portion 90 of the insulated housing 70. The blade portion 114 is configured to mate with a female electrical conductor as will be discussed in greater detail below. Although the male electrical conductor 82 has been disclosed as having the blade portion 114, any number of electrical conductors of differing shape, for example, round, triangular or the like that would be known to one of ordinary skill in the art with the present disclosure before them are likewise contemplated for use in accordance with the present invention.

The second portion 66 of the electrical disconnect 14 is constructed similarly to the first portion 62 and includes an insulated housing 122 which substantially covers a supporting enclosure 126, a conductor body 130 and one or more female electrical conductors 134. The insulated housing 122 may be constructed from, or covered by, a dielectric material, for example, a rubber, glass, polytetrafluroethylene, or the like. The insulated housing 122 includes an opening 138 formed to receive at least a portion of the service line segment 58 (see FIG. 3) of the drip loop 18 therethrough.

The supporting enclosure 126 is disposed at least partially within the housing 122 and is provided to substantially cover at least a portion of the conductor body 130 and the one or more female electrical conductors 134. In one embodiment, the supporting enclosure 126 is provided with a substantially cylindrical body 142 (see FIG. 4) having a cover plate 146. The substantially cylindrical body 142 and the cover plate 146 cooperate to substantially cover and electrically insulate the one or more female electrical conductors 134. Additionally, the cover plate 146 is provided with a slot 150 that is constructed to allow for the insertion of at least a portion of the blade portion 114 of the male electrical conductor 82 into the substantially cylindrical body 142 of the second portion 66 such that the blade portion 114 may interface with the one or more female electrical conductors 134. It will be understood that the number of slots 150 may be dictated by the number of male electrical conductors 82 of the first portion 62.

It will be understood that because the female electrical conductor 134 is entirely contained within the cylindrical body 142 of the support enclosure 126 which is, in turn, covered by the insulating housing 126, any danger of electrical shock to those who would come into contact with the second portion 66 is substantially minimized.

In one embodiment, the supporting enclosure 126 is constructed having a cylindrical collar 154. The cylindrical collar 154 is adapted to receive at least a portion of the cylindrical protrusion 98 of the supporting enclosure 74 of the first portion 62 to secure the supporting enclosure 74 of the first portion 62 to the supporting enclosure 126 of the second portion 66 in an overlapping relationship when the first portion 62 and the second portion 66 are joined together.

The conductor body 130 is disposed within the insulated housing 122 and is constructed of an electrically conductive material, for example, copper, gold, silver, aluminum, graphite and the like. The conductor body 130 includes a first portion 158 having an opening 162 disposed in axially alignment with the opening 138 of the insulated housing 122 to receive and retain at least a portion of the service line segment 58 (see FIG. 3) of the drip loop 18 therein. The conductor body 130 provides for the communication of an electrical current from the service line segment 58 of the drip loop 18 to the one or more female electrical conductor 134.

The one or more female electrical conductors 134 comprise a connector portion 166 and a pair or conductor plates 170. The one or more female electrical conductors 134 are constructed of an electrically conductive material, for example, copper, gold, silver, aluminum, graphite and the like. The connector portion 166 is connectable to the conductor body 130 via a fastener 174, for example, a threaded fastener, although any number of fasteners which would be known to one of ordinary skill in the art with the present disclosure before them are likewise contemplated for use in accordance with the present invention. Additionally, it will be understood that the one or more female electrical conductors 134 and the conductor body 130 may be fabricated as a unitary member.

The pair of conductor plates 170 of the one or more female electrical conductors 134 are provided in a spaced apart configuration and are adapted to releaseably secure at least a portion of the blade portion 114 of the male electrical conductor 82 therebetween when the first portion 62 and the second portion 66 are joined together. In one embodiment, the connection between the male electrical conductor 82 and the one or more female electrical conductors 134 is an interference fit. When a force of sufficient magnitude (e.g., a force strong enough to separate the interference fit between the blade portion 114 of the male electrical conductor 82 and the pair of conductor plates 170 of the one or more female electrical conductors 134) is applied to one of the electrical conductor lines 22, 26 or the neutral line 30 having one of the electrical disconnects 14, the blade portion 114 of the male electrical conductor 82 separates from the pair of conductor plates 170 of the one or more female electrical conductors 134 causing a cessation of electrical current through the electrical disconnect 14. In one embodiment, the predetermined amount of force may be less than the ultimate tensile strength of the connector 42 joining the neutral line 30 to the structure 38.

It will be understood that although the connection between the blade portion 114 of the male electrical conductor 82 and the pair of conductor plates 170 of the one or more female electrical conductors 134 has been disclosed as an interference fit, any other type of detachable connection between the male electrical conductor 82 and the female electrical conductor 134 that will allow the male electrical conductor 82 to separate from the female electrical conductor 134 when a predetermined amount of force has been applied to one of the electrical conductor lines 22, 26 and the neutral line 30 having an electrical disconnect 14 are likewise contemplated for use in accordance with the present invention.

By way of non-limiting operational example, during wintery weather ice may accumulate along the length of the electrical service line 10. The ice accumulating along the electrical service line 10 adds additional weight and stresses to not only the electrical conductor lines 22 and 26, but also the neutral line 30 which supports the weight of the electrical conductor lines 22 and 26. If enough ice accumulates on the electrical service line 10, the neutral line 30 may detach from the structure 38. If the neutral line 30 detaches from the structure 38, the electrical conductor lines 22 and 26 may be torn from the weatherhead 50 of the meter assembly 46 potentially causing damage to not only the weatherhead 50, but the various parts of the meter assembly 46. In addition to any damage caused to the meter assembly 46, the disconnected electrical conductor lines 22 and 26 may fall to the ground while still attached to the utility pole 34 leaving "live" wires that pose a significant risk of electrical shock and/or death for any living being which might come into contact with them.

Each of the conductor plates 170 is shown to include a planar portion 176 and a contact portion 178. The contact portion 178 extends from one end of the planar portion 176 and loops inwardly toward the opposing conductor plate 170. The supporting enclosure 126 of the second portion is provided with a pair of inwardly extending protrusions 180 terminating at a position adjacent an intermediate point of the planar portion 176 of the conductor plates 170 thereby limiting the expansion of the conducting plates 170 upon insertion of the blade portion 114 between the conductor plates 170.

Therefore, the inclusion of the electrical disconnects 14 to the drip loops 18 of the electrical conductor lines 22 and 26 are provided to minimize such risks. If the neutral line 30 detaches from the structure 38, the first portions 62 and the second portions 66 of the electrical disconnects 14 will separate from one another such that the first portions 62 are left hanging from the weatherhead 50. Because the one or more male electrical conductors 82 of the first portion 62 do not carry a current when they are disconnected from the one or more female electrical conductors 134 of the second portion 66 they do not pose a risk for electrical shock. Furthermore, as stated previously, as the one of more female electrical conductors 134 are entirely contained within the cylindrical body 142 of the support enclosure 126 of the second portion, any danger of electrical shock to those who would come into contact with the second portion 66 is substantially minimized.

Additionally, in some situations it may be desirable for an individual, and not necessarily a licensed electrician or an emergency worker, to sever the connection between the utility pole 34 and the structure 38. The electrical disconnects 14 provide a safe and efficacious means for severing the connection between the utility pole 34 and the structure 38. The individual need only separate the first 62 and second 66 portions of the electrical disconnects 14 on each of the electrical conductor lines 22 and 26 and/or the neutral line 30 to sever the connection between the utility pole 34 and the structure 38.

To install the electrical disconnect 14 along the drip loop 18 of the electrical conductor line 22, the drip loop 18 is divided into the structure side segment 54 and the service line segment 58. Next, the insulated covering of the structure side segment 54 is stripped to reveal the wiring inside the conductor line 22. The insulated housing 70 of the first portion 62 is separated from the supporting enclosure 74 and the conductor body 78. The stripped end of the structure line segment 54 is joined to the first portion 102 of the conductor body 78 by inserting the stripped end through the opening 86 of the insulated housing 70 and the opening 106 of the conductor body 78 and into the first portion 102 of the conductor body 78. The first portion 102 is crimped around the stripped end of the structure side segment 54 to secure the wire therein. The insulating housing 70 is then slidably engaged to cover the supporting enclosure 74 and the conductor body 78. The service line segment 58 is joined to the second portion 66 in similar fashion. The same steps are repeated for installing an electrical disconnect 14 along the drip loops 18 of the second electrical conductor line 26 and the neutral line 30.

In another embodiment, the electrical disconnect 14 is installed along the drip loop 18 of the electrical conductor line 22 by dividing the drip loop 18 into the structure side segment 54 and the service line segment 58. Next, the structure side segment 54 is secured to the first portion 62 by first removing the threaded fastener 118 from the conductor body 78 through opening 86 of the insulated housing 70 and opening 106 of the conductor body 78. After removing the threaded fastener 118, a portion of the end of the structure side segment 54 is wound around the threaded fastener 118. Next, the threaded fastener 118 with the structure side segment 54 wound thereto is inserted through opening 86 of the insulated housing 70 and opening 106 of the conductor body 78 and is threaded onto the conductor body 78 securing the structure side segment 68 therein.

The service line segment 58 is secured to the second portion 66 by first removing the threaded fastener 174 from the conductor body 130 through opening 138 of the insulated housing 122 and opening 162 of the conductor body 130. After removing the threaded fastener 174, a portion of the end of the service line segment 58 is wound around the threaded fastener 174. Next, the threaded fastener 174 with the service line segment 58 wound thereto is inserted through opening 138 of the insulated housing 122 and opening 162 of the conductor body 130 and is threaded onto the conductor body 130 securing the service line segment 58 therein. The above steps are repeated for installing an electrical disconnect 14 along the drip loop 18 of the neutral line 30.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. An electrical disconnect, comprising:

a first portion having a male electrical conductor, a supporting enclosure covering a portion of the male electrical conductor, and an insulated housing substantially covering the supporting enclosure, the male electrical conductor including a single blade, the supporting enclosure having a cylindrical protrusion from which a portion of the single blade extends and the cylindrical portion provided with a smooth peripheral surface, the insulated housing having an annular extension portion with a smooth interior surface, the annular extension extending beyond the cylindrical portion of the support enclosure; and a second portion having a female electrical conductor, a supporting enclosure entirely covering the female electrical conductor, and an insulated housing covering the supporting enclosure, the female electrical conductor including at least two conductor plates spaced apart to receive the single blade, the supporting enclosure of the second portion having an annular collar with a smooth inner surface slidably positionable about the smooth peripheral surface of the cylindrical protrusion of the first portion to laterally support the second portion relative to the first portion when the single blade is received between the conductor plates, the annular collar of the supporting enclosure of the second portion slidably removable from about the cylindrical protrusion upon separation of the single blade from the conductor plates, the insulated housing of the second portion having an annular recess with a smooth peripheral surface for receiving the extended portion of the insulated housing of the first portion when the single blade is received between the conductor plates, the conductor plates supported in such a way that the electrical conductor plates apply a holding force to the single blade, yet the single blade slidably separates from the conductor plates when a predetermined tension force is applied to the first and second portions.

2. The electrical disconnect of claim 1, wherein the supporting enclosure of the second portion is provided with a pair of inwardly extending protrusions terminating at a position adjacent the conductor plates to limit the expansion of the conductor plates upon insertion of the single blade between the conductor plates.

3. The electrical disconnect of claim 2, wherein each of the conductor plates has a planar portion a contact portion, the contact portion extending from one end of the planar portion and looping inwardly toward an opposing conductor plate, and wherein the terminating end of the inwardly extending protrusions of the supporting enclosure are positioned adjacent an intermediate point of the planar portion of the conductor plates.

4. The electrical disconnect of claim 3, wherein each of the inwardly extending protrusions of the supporting enclosure has a planar configuration and each inwardly extending protrusion is oriented in a perpendicular relationship relative to the planar portion of the conductor plates.

5. An electrical disconnect, comprising:

a first portion having a male electrical conductor, a supporting enclosure covering a portion of the male electrical conductor, and an insulated housing substantially covering the supporting enclosure, the male electrical conductor including a single blade; and a second portion having a female electrical conductor, a supporting enclosure entirely covering the female electrical conductor, and an insulated housing covering the supporting enclosure, the female electrical conductor including at least two conductor plates spaced apart to receive the single blade, the supporting enclosure of the second portion is provided with a pair of inwardly extending protrusions terminating at a position to limit the expansion of the two conductor plates upon insertion of the single blade between the conductor plates such that the electrical conductor plates apply a holding force to the single blade, yet the single blade slidably separates from the conductor plates when a predetermined tension force is applied to the first and second portions.

6. The electrical disconnect of claim 5, wherein each of the conductor plates has a planar portion and a contact portion, the contact portion extending from one end of the planar portion and looping inwardly toward an opposing conductor plate, and wherein the terminating end of the inwardly extending protrusions of the supporting enclosure are positioned adjacent an intermediate point of the planar portion of the conductor plates.

7. The electrical disconnect of claim 6, wherein each of the inwardly extending protrusions of the supporting enclosure has a planar configuration and each inwardly extending protrusion is oriented in a perpendicular relationship relative to the planar portion of the conductor plates.

* * * * *